US005201939A

United States Patent [19]

Siemers

[11] Patent Number: 5,201,939

[45] Date of Patent: Apr. 13, 1993

[54] METHOD OF MODIFYING TITANIUM ALUMINIDE COMPOSITION

[75] Inventor: Paul A. Siemers, Clifton Park, N.Y.

[73] Assignee: General Electric Company, Schenectady, N.Y.

[21] Appl. No.: 445,203

[22] Filed: Dec. 4, 1989

[51] Int. Cl.[5] ..... C22C 1/00

[52] U.S. Cl. ..... 75/10.19; 95/10.21; 427/455

[58] Field of Search ..... 75/10.19, 10.21; 427/34

[56] References Cited

U.S. PATENT DOCUMENTS

| | | | |
|---|---|---|---|
| 3,573,090 | 3/1971 | Peterson | 427/34 |
| 4,561,883 | 12/1985 | Müllner et al. | 75/10.19 |
| 4,792,431 | 12/1988 | Eckert | 75/10.19 |
| 4,805,294 | 2/1989 | Siemers | 427/34 |
| 4,806,384 | 2/1989 | Kelly | 427/34 |
| 4,838,337 | 6/1989 | Siemers | 427/34 |
| 4,839,239 | 6/1989 | Ducos et al. | 427/34 |
| 4,853,250 | 8/1989 | Boulos et al. | 427/34 |
| 4,943,492 | 7/1990 | Holroyd et al. | 428/654 |
| 4,952,236 | 8/1990 | Wang et al. | 75/10.19 |

OTHER PUBLICATIONS

Metals Handbook, Ninth Edition, vol. 5, Surface Cleaning, Finishing, and Coating, 1982, pp. 363.

E. J. Hellund, "The Plasma State", Reinhold Publishing, New York, 1961, pp. 168–169.

Brunet et al., "The importance of particle size distribution on the plasma . . . " Surface Coating Technology, vol. 31, No. 1, 1987, pp. 1–10, Chem. Abs. #107:82128n.

Intermetallic Compounds (ed) J. H. Westbrook, pp. 303, 319, 328–335, John Wiley, N.Y. 1966.

*Primary Examiner*—Upendra Roy

*Attorney, Agent, or Firm*—Paul E. Rochford; James C. Davis, Jr.; James Magee, Jr.

[57] ABSTRACT

A method of altering the composition of an alloy deposited by plasma-spray processing is disclosed. It has been found that the composition of a powder can be altered by selective vaporization of the more volatile components of the alloy. In order to do this, the gas mixture employed in the plasma processing is modified to a composition which imparts a higher superheat to the liquid particles undergoing plasma processing. In this way, an alloy which is out-of-specification can be brought within the specification as to its composition by reducing the more volatile components and accordingly increasing the concentration of the less volatile components.

7 Claims, 1 Drawing Sheet

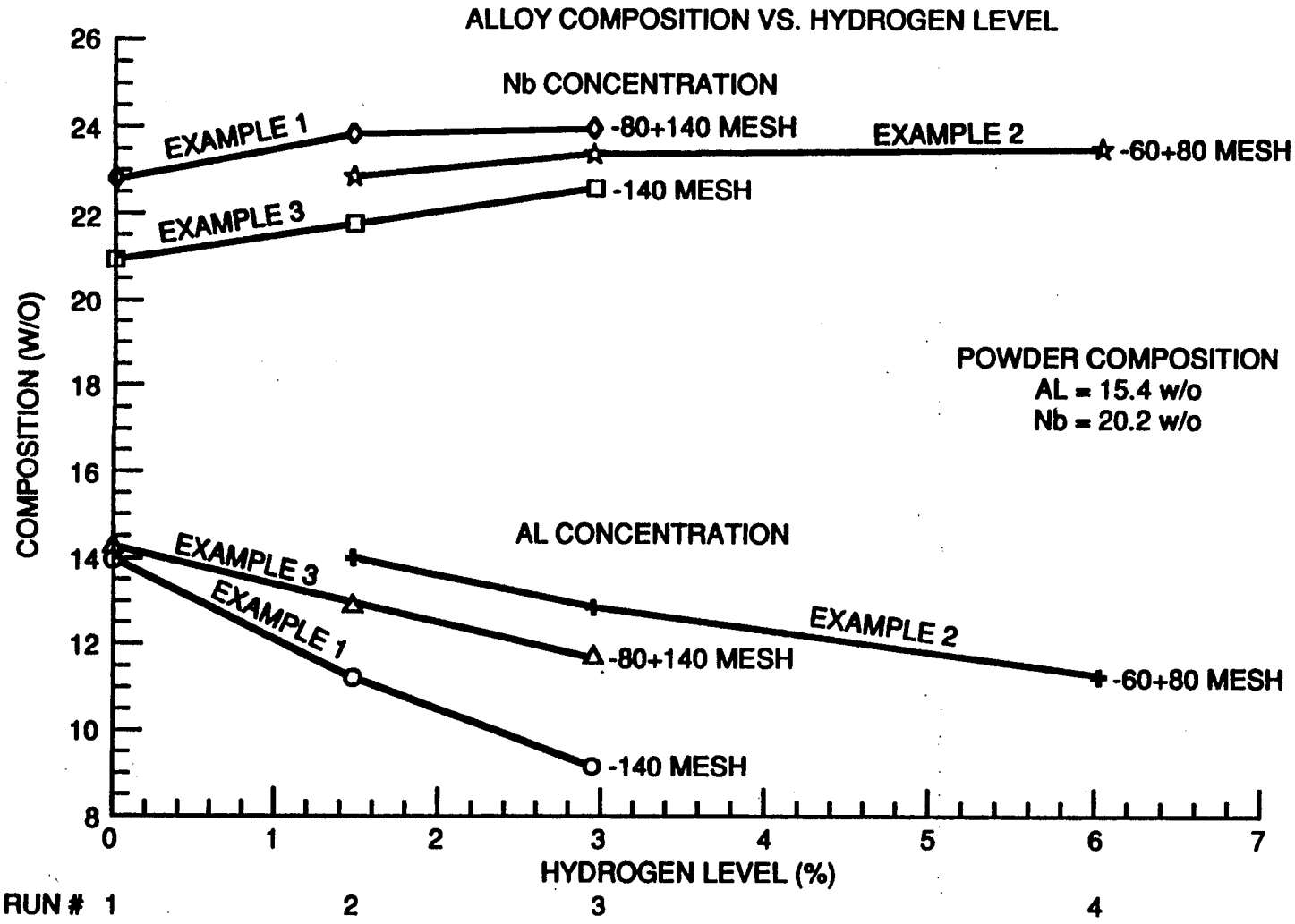
ALLOY COMPOSITION VS. HYDROGEN LEVEL
Nb CONCENTRATION
-80+140 MESH
-140 MESH
-60+80 MESH
EXAMPLE 1
EXAMPLE 2
EXAMPLE 3
POWDER COMPOSITION
AL = 15.4 w/o
Nb = 20.2 w/o
AL CONCENTRATION
-60+80 MESH
-80+140 MESH
-140 MESH
EXAMPLE 2
EXAMPLE 3
EXAMPLE 1
COMPOSITION (W/O)
26
24
22
20
18
16
14
12
10
8
HYDROGEN LEVEL (%)
0
1
2
3
4
5
6
7
RUN # 1
2
3
4

METHOD OF MODIFYING TITANIUM ALUMINIDE COMPOSITION

CROSS-REFERENCE TO RELATED APPLICATIONS

U.S. Pat. Nos. 4,978,585, issued Dec. 18, 1990; and 5,017,438, issued May 21, 1991.

BACKGROUND OF THE INVENTION

The present invention relates generally to the processing of titanium aluminides to form articles and reinforced articles. More particularly, it relates to a plasma-spray technology which is applied to modify the composition of titanium aluminides as they are being processed and to the articles which are formed by such processing.

It is known that the titanium aluminides, and particularly intermetallic compositions of titanium and aluminum, have a very desirable set of properties for use at higher temperatures. Intermetallic compositions of titanium and aluminum can be employed at temperatures of 1,000° F. and higher. One of the problems associated with the use of the aluminides is that they tend to be somewhat brittle at room temperatures. However, recent developments have permitted the formation of modified titanium aluminides which have desirable properties at elevated temperatures but which also have significant ductility at room temperatures. One such modified composition is described in U.S. Pat. No. 4,842,819.

The titanium based materials have a desirable set of properties at elevated temperatures which makes it appropriate to consider them for use in high temperature, high stress applications such as in gas turbines, and in jet engines. One of the ways in which it is proposed to process the titanium compositions is through a plasma-spray deposition process. This process involves formation of a plasma by passing a current through a gas to cause ionization of the gas and by then passing fine particles of the material to be spray deposited through the plasma so that the finely divided material is heated to a temperature above its melting point as it passes through the plasma. In this way, deposits of material which are difficult to process have been made. For example, deposits of refractory metals and ceramic materials have been made in this fashion. The subject invention concerns the plasma-spray deposit of a titanium aluminide to form either a monolithic deposit or to form a composite of titanium aluminide with a reinforcing structure. The formation of such structures is disclosed in U.S. Pat. Nos. 4,775,547; 4,782,884; 4,786,566; 4,805,294; 4,805,833; and 4,838,337; assigned to the same assignee as the subject invention.

I have found that the mechanical properties of titanium alloys are sensitive to the composition of the powder used in this spray process. In the manufacture of titanium alloy powders, it is not uncommon for the powder composition to deviate from the desired composition. If the deviation of the composition from a desired standard is large, the deposit made from the powder will be defective because of the inappropriate proportions of ingredients and the alloy will have to be discarded or will have to be remelted. Such discarding or remelting of finished plasma-spray deposited pieces is very expensive and considerable financial cost to the user can result.

The formation of powder with a very precise ratio of titanium to aluminum is also not a simple or easy step or process and it is not uncommon for powder compositions which are prepared to be somewhat out of specification in that the proportions of the ingredient aluminum and titanium do not match those of the specification. Such "out-of-spec" powders can be very costly to the powder manufacturer and result in a need for very expensive reprocessing.

Further, because of the very strong tendency of titanium based materials to absorb and react with oxygen, the reprocessing of titanium-based materials, particularly the reprocessing of powder, can result in the material having a higher than desired oxygen content and can result in the material being out of specification for this reason.

I have discovered that it is possible to modify powder compositions in subsequent processing steps and in this way to avoid or overcome some of the inherent difficulties in the powder processing of titanium-based materials.

BRIEF STATEMENT OF THE INVENTION

It is, accordingly, one object of the present invention to provide a method by which the composition of alloy based materials may be modified during manufacture to yield products having a desired combination of properties.

Another object is to provide a method of altering the ratio of the ingredients of the alloy during the plasma-spray deposit thereof.

Another object is to provide a method of producing in-spec products from out-of-spec powder.

Another object is to provide a method for producing products having a superior set of properties.

Other objects will be in part apparent and in part pointed out in the description which follows.

In one of its broader aspects, the objects of the present invention can be achieved by providing an RF plasma-spray gun, providing a combination of parameters to regulate the degree of superheat generated in particles of alloy metal passing through the plasma of said gun, supplying a gas to said gun and igniting the plasma of said gun, passing powder particles through said plasma to melt the particles, modifying the operating parameters to modify the superheat of the metal alloy particles passing through said plasma to preferentially evaporate a portion of the more volatile ingredients of the alloy particles as they pass through the plasma, and altering the parameters to increase or decrease the superheat of said alloy particles.

BRIEF DESCRIPTION OF THE DRAWING

FIG. 1 is a graph in which a composition in weight percent of an alloy is plotted against the hydrogen content in percent of a gas mixture employed in a plasma gun.

DETAILED DESCRIPTION OF THE INVENTION

I have discovered that the elements of higher volatility can be preferentially volatilized reliably and reproducibly from their alloy base during a plasma-spray processing thereof. This preferential volatilization is accomplished by varying the superheat of the melted powder particle during plasma deposition. The superheat of the powder particles can be varied by adjusting a number of plasma processing parameters, including the amount of hydrogen or other secondary gas used in the plasma gas mixture during deposition.

I have found, for example, that, as one of a number of plasma processing parameters, higher levels of the secondary gas result in a greater amount of powder superheat and hence a greater amount of vaporization of the more volatile components of the alloy during the plasma-spray processing. By use of this approach, of varying the plasma processing parameters in the plasma-spray processing, I am able to fine-tune the alloy content of powder employed in a plasma-spray process to achieve a desired specification of the composition in the deposited material.

This concept of selective volatilization of elements can be employed in a number of alloy systems. For example, in nickel-based superalloy systems the chromium content can be selectively reduced by selective volatilization. In a niobium-titanium alloy system the titanium content can be modified by selective volatilization during a plasma-spray deposit deposition processing.

Regarding next the set of parameters which govern the superheat imparted to a plasma heated particle, there are a number of such parameters and a brief explanation is given here of some of the factors which bear on the regulation of the degree of superheat and consequently the degree to which the more volatile of the constituents of an alloy composition may be altered in carrying out the plasma-spray process. In discussing the parameters and the processing, it should first be realized that the method of the present invention is capable of causing very precise changes in the concentrations of the volatile constituents of an alloy composition.

A first parameter in operating a plasma-spray process is the construction of the gun itself. A suitable gun is described in the six patents referred to above which are assigned to the same assignee as the subject application. The gun described in those patents is a radio frequency gun in which the radio frequency is employed to ignite and maintain the plasma. An alternative gun construction is described in the copending application, Ser. No. 07/524,527, filed May 17, 1990.

A second factor dealing with the structure and operation of the guns is the frequency at which the gun is operated. This factor is discussed to some extent in the copending application, Ser. No. 07/524,527. In general, the higher the frequency, the greater the coupling of the radio frequency energy to the gas but also the higher the likelihood of strikeover. I have found that this process operates well with any RF gun which can accept substantially high plate power input of 60 kilowatts or more.

A further factor which concerns the degree of superheat imparted to particles passing through an RF plasma is the content of the gas mixture employed in the gun and, accordingly, the gas which becomes dissociated in the plasma. There are two factors which govern the heat transferred to the particles because of characteristics of the gas mixture.

The first is the heat content of the gas, that is a measure of the heat which is present in the gas and which can be transferred to the particles. The heat content depends on the temperature of the gas and also the heat capacity of the gas.

The second factor is the thermal conductivity of the gas. This determines how quickly heat which is contained in the gas can be transferred to the particles and in this sense determines from how far away from the particle itself the particle can draw heat from the gas.

In operation of a RF plasma gun, two types of gases are of concern. One is a diatomic gas such as hydrogen, nitrogen, or oxygen. These gases undergo dissociation before ionization and acquire a dissociation energy. This dissociation occurs at about 3,500° K. to 7,500° K. The dissociation of the gas increases the heat capacity and thermal conductivity of the gas. Generally, lighter gases have greater conductivity. As, for example, hydrogen or helium, have high thermal conductivities. In this regard, hydrogen is one of the best gases with regard to heat conductivity. However, one problem with hydrogen is that it tends to soak up the energy of the plasma so fast thus constricting the plasma such that the plasma may be extinguished due to the presence of a higher concentration of hydrogen in the plasma.

Another factor bearing on the degree of superheat which can be imparted to a particle during its flight through the plasma is the frequency of the energizing electric field. High frequency of more than one megahertz can be used as in the manner described in the 6 patents referenced above in the background statement. However, as noted there, there is a tendency for an arc strikeover. At the higher frequencies, a higher concentration of hydrogen in the order of 3–4% can be employed. By contrast, the lower frequencies' tendency to strikeover is greatly reduced. However, it is more difficult to couple the electric field to the gas to cause the ionization. At the lower frequency, it is sometimes necessary to add coils to the plasma gun. At the lower frequency, also the concentration of hydrogen which can be tolerated in the gas is relatively low and of the order of 0.5% or less.

Another factor bearing on the degree of heat imparted to the particles is the composition of the gas. I have found that helium does not have the same degree of constrictive effect on the plasma that hydrogen does. This may be partly because the helium is a monatomic molecule. If helium is included in the gas and lower frequency RF of about 420K Hertz is used, the hydrogen concentration of up to about 6% can be used. Gas compositions containing about $\frac{2}{3}$'s helium and $\frac{1}{3}$ argon have been found to provide stable plasma operation.

Still another factor bearing on the degree of superheat of the particles is the particle size itself. Particles of sieve fractions of −80 to +140 (105–144 μm) can be melted in a RF plasma containing a mixture of $\frac{2}{3}$'s helium and $\frac{1}{3}$ argon. However, for normal operation, the particles may be just melted and in such case the composition of the particles is not changed in the plasma-spray process. One way to impart a higher level of superheat to the particles is by reducing the size of the particles. However, for some materials, this increased particle size may result in simultaneous increase in the concentration of oxygen which is found in the spray deposited product.

Another factor bearing on the degree of superheat imparted to the particle is the residence time of the particles in the plasma. This may, in turn, be broken down into additional factors. A first additional factor is the rate at which gas moves in the gun. It is the slip velocity of the gas which is a factor that partly controls the heating of the particle.

A second factor is the rate at which the particle moves in the plasma. For increased heating, the residence time of the particle in the plasma should be increased and this can be accomplished by reducing the rate of travel of the particle through the plasma. Also, the residence time can be increased by decreasing the rate at which the gas moves in the gun.

In this regard, concern must be given to the trajectory of the particles. The particle must have a sufficient trajectory, based on its injection into the plasma, and based on the rate of movement of gas within the plasma so that it can reach the deposit zone.

A number of factors enter into the processing of the material. The following examples illustrate the way in which processing factors and parameters can be controlled to achieve a desirable plasma deposition. The control is to achieve a modification of the product composition as compared to the starting composition.

EXAMPLES 1-3

A plasma-spray deposit processing of titanium-based alloys was carried out.

The alloy employed was nominally Ti-14Al-21Nb (Ti-1421). This alloy nominally has 14% aluminum, 21% niobium and the balance titanium. The alloy was obtained in powdered form and the powder was sieved to produce fractions in different size ranges as follows: +60, −60+80, −80+140, and −140 mesh. The nominal powder particle diameter for each size range was as follows: for the +60 fraction, >250μm; for the −60+80 fraction, 177-250μm; for the −80+140 fraction, 105-177μm; for the −140 mesh fraction, <105μm. The composition in weight percent of the starting powder was measured and found to actually be 15.4% Al, 20.2% Nb, and the balance titanium. The finest three fractions and specifically −60+80, −80+140, and −140 mesh fractions were low pressure RF plasma-sprayed onto steel substrates. The −60+80 fraction was used in Example 2; the −80+140 fraction was used in Example 1; and the −140 fraction was used in Example 3. The steel substrates had been preheated by the plasma torch to about 800° C. The gas used during the plasma-spray deposition of the fractions of the nominal Ti-1421 alloy powder was varied as to its hydrogen content in what is designated in FIG. 1 as Run 1 for 0% $H_2$; Run 2 for 1.5% $H_2$; Run 3 for 3% $H_2$; and Run 4 for 6% $H_2$. Specifically, the hydrogen content of the gas was varied between 0 and 6% by volume as listed in the following Table I:

TABLE I

Gas Flows in Standard Liters Per Minute (sl/m) For RF Plasma Spray Deposit of Ti-1421

| | | Gas Flow Conditions in sl/m | | | |
|---|---|---|---|---|---|
| Type | Gas | Run 1 | Run 2 | Run 3 | Run 4 |
| Swirl | Ar | 16 | 16 | 16 | 16 |
| Radial | $H_2$ | 0 | 3.7 | 7.4 | 14.8 |
| Radial | Ar | 70 | 70 | 70 | 70 |
| Radial | He | 148 | 148 | 148 | 148 |
| Powder | He | 5 | 5 | 5 | 5 |

After deposition, the spray deposits were cut from the steel substrate and the composition was analyzed. The results of the analysis are displayed in FIG. 1.

From the data which is plotted in FIG. 1, it is evident that the aluminum level of the spray deposit decreased as the hydrogen level in the plasma gases was increased. I have found that the aluminum level in the deposit can be reduced by as much as 3.5 weight percent employing the conditions outlined above and in FIG. 1. FIG. 1 further indicates that the niobium level of the deposit apparently increases as the hydrogen level of the plasma gases is increased.

Another perspective on the tests conducted is that for a constant hydrogen level in the plasma gases, the loss of aluminum during the processing, and accordingly in the resulting deposit, increases as the size of the starting powder is decreased. Accordingly, for the plasma conditions which are maintained constant, the use of smaller particles results in their being heated to a higher temperature and the aluminum can accordingly vaporize from the higher temperature particles with the larger surface area per unit mass which attends the smaller size of particles.

What is claimed is:

1. A method of forming a deposit of an alloy to precise atomic ratio of constituent elements which comprises,
   - providing an alloy specimen having an atomic ratio of constituents which is slightly above a predetermined value with respect to the more volatile constituents,
   - converting said alloy specimen into finely divided powdered form,
   - plasma-spray depositing said powdered specimen through a RF activated plasma, and
   - imparting a superheat to metal particles of said powder as they pass through said plasma to vaporize at least a portion of the more volatile constituent of said powdered specimen and to bring said atomic ratio to a predetermined value.

2. The method of claim 1, in which the superheat is imparted by increasing the residence time of the particles in the RF plasma.

3. The method of claim 1, in which the superheat is imparted by decreasing the particle size of the specimen passed through the RF plasma.

4. The method of claim 1, in which the superheat is imparted by including a few percent of hydrogen gas in the RF plasma.

5. The method of claim 1, in which the superheat is imparted by an RF plasma of a gas mixture containing ⅓ argon and ⅔ helium.

6. A method of altering the composition of an alloy which comprises,
   - providing an RF plasma gun,
   - providing a gas mixture, including hydrogen, for supply to said gun to regulate the degree of superheat generated in particles of alloy metal passing through the plasma of said gun,
   - supplying said mixture to said gun and igniting the plasma of said gun,
   - passing alloy powder particles through said plasma to form a deposit of said alloy, and
   - modifying the hydrogen content of the gas mixture supplied to said gun to modify the superheat of metal alloy particles passing through said plasma to preferentially evaporate a portion of the more volatile ingredients of the alloy particles as they pass through the plasma.

7. The method of claim 6, in which the concentration of aluminum in a Ti-14Al-21Nb alloy is reduced.

* * * * *